United States Patent [19]

Hayakawa

[11] Patent Number: 4,529,111

[45] **Date of Patent: * Jul. 16, 1985**

[54] BUCKLE FOR A BELT

[75] Inventor: Shinichi Hayakawa, Seki, Japan

[73] Assignee: Hayakawa Industry Co., Ltd., Seki, Japan

[ * ] Notice: The portion of the term of this patent subsequent to May 24, 2000 has been disclaimed.

[21] Appl. No.: 391,552

[22] Filed: Jun. 24, 1982

[30] Foreign Application Priority Data

Dec. 22, 1981 [JP] Japan ..... 56-191422[U]

[51] Int. Cl.[3] ..... A44B 11/00

[52] U.S. Cl. ..... 224/163; 7/158; 24/163 K; 30/162; 224/229; 224/904

[58] Field of Search ..... 7/151, 152, 138, 158; 224/163, 232, 229, 904; 24/163 R, 163 K, 186, 3 R, 3 F, 10 R, 10 A, 11 CT; 30/162, 336, 339; 40/21 C; D2/378, 405

[56] References Cited

U.S. PATENT DOCUMENTS

| | | | |
|---|---|---|---|
| 472,104 | 4/1892 | Von Bültzingslöwen | 7/158 X |
| 989,213 | 4/1911 | Waw | 24/10 A |
| 1,599,920 | 4/1925 | Pryor . | |
| 1,728,128 | 9/1929 | Kodama | 24/11 CT |
| 2,285,155 | 6/1942 | Frost | 30/162 |
| 2,353,502 | 7/1944 | Reynolds | 24/10 R X |
| 2,397,444 | 3/1946 | Stern | 30/162 |
| 2,618,057 | 11/1952 | Gibson | 224/232 |
| 2,779,098 | 1/1957 | Pocoski et al. | 7/151 X |
| 2,984,003 | 5/1961 | Minton | 30/162 |
| 3,461,469 | 8/1969 | Morrision . | |
| 3,969,836 | 7/1976 | DuBois | 40/21 C |
| 4,078,272 | 3/1978 | Mahon . | |
| 4,384,390 | 5/1983 | Hayakawa | 24/163 X |

FOREIGN PATENT DOCUMENTS

| | | | |
|---|---|---|---|
| 1037921 | 9/1978 | Canada | 224/232 |
| 125997 | 5/1928 | Switzerland | 224/232 |

*Primary Examiner*—William E. Lyddane
*Assistant Examiner*—James R. Brittain
*Attorney, Agent, or Firm*—Leydig, Voit, Osann, Mayer & Holt, Ltd.

[57] ABSTRACT

Described is a belt buckle to which may be attached a tool in the form of a flat plate. The buckle body is formed by a fitting case and a base plate mounted to the rear surface of the fitting case. A leaf spring is mounted in the buckle body for pressingly holding the tool in the housed state. The plate spring has a pair of short strips for acting on the central part of the tool and a long strip for acting on the inner end of the tool. The upper and lower sides of the foremost portions of the fitting case are bent back to provide an engaging portion for preventing inadvertent withdrawal of the tool from the buckle body. When withdrawing the tool housed in the buckle body, it is only necessary to apply finger pressure on the end of the tool exposed through the central end notch of the fitting case.

5 Claims, 4 Drawing Figures

BUCKLE FOR A BELTcl FIELD OF THE INVENTION

This invention relates to a buckle for a belt and more particularly to a buckle for a belt to which may be removably attached a multipurpose plate-like tool.

BACKGROUND OF THE INVENTION

The buckle of this type has been disclosed in my copending U.S. patent application Ser. No. 194,073, now U.S. Pat. No. 4,384,390 entitled "Buckle for Belt".

As illustrated in FIGS. 1 and 2 of the above patent application Ser. No. 194,073, now U.S. Pat. No. 4,384,390 with the multipurpose tool inserted in position in the buckle, a leaf spring as a lock member secured to the inside of the buckle is bent at a right angle towards the rear for defining a stepped pressure portion. The foremost part of the lock member enters an engagement opening of the multipurpose tool and a pressure portion abuts on the right hand end edge of the engagement opening for the overall plate thickness so as to hold the foremost part of the multipurpose tool in position. A rubber magnet is secured to the inner base part of the buckle so as to attract the rear part of the multipurpose tool. In this manner, the tool may be held in its entirety within the buckle.

The buckle mentioned above has a drawback in that the structure and hence the manufacture may be complex and the manufacture costs elevated because of the necessity for providing the rubber magnet and bending the foremost part of the leaf spring at a right angle.

Besides, when removing the multipurpose tool from the buckle, the pressure portion of the lock member has to be pushed out with the finger's tip inserted through a square-shaped aperture formed through a fitting case of the buckle for disengaging the lock member from the engagement opening, which is a complicated and troublesome operation.

OBJECT OF THE INVENTION

It is a principal object of the present invention to provide a belt buckle in which the buckle body is simple in structure and manufacture and in which the plate-like tool can be easily attached to and dismounted from the buckle body while the user wears the belt.

Another object of the present invention is to provide a belt buckle wherein the lock mechanism in the main body of the buckle is simplified in structure so that the plate-like tool mounted in the buckle body may be locked and dismounted positively.

Another object of the present invention is to provide a belt buckle wherein the plate-like tool may be mounted positively and the tool is not liable to be detached from the buckle body.

Yet another object of the present invention is to provide a belt buckle to which can be attached a square-shaped metallic plate-like tool having plural functions such as cap opening, can cutting, etc.

Other objects of the present invention will become more apparent from the following description of the preferred embodiment thereof and the appended claims. Many advantages not alluded to herein will be obvious to those engaged in the art upon practicing the present invention.

DETAILED DESCRIPTION OF THE PREFERRED EMBODIMENT

Figure 2:
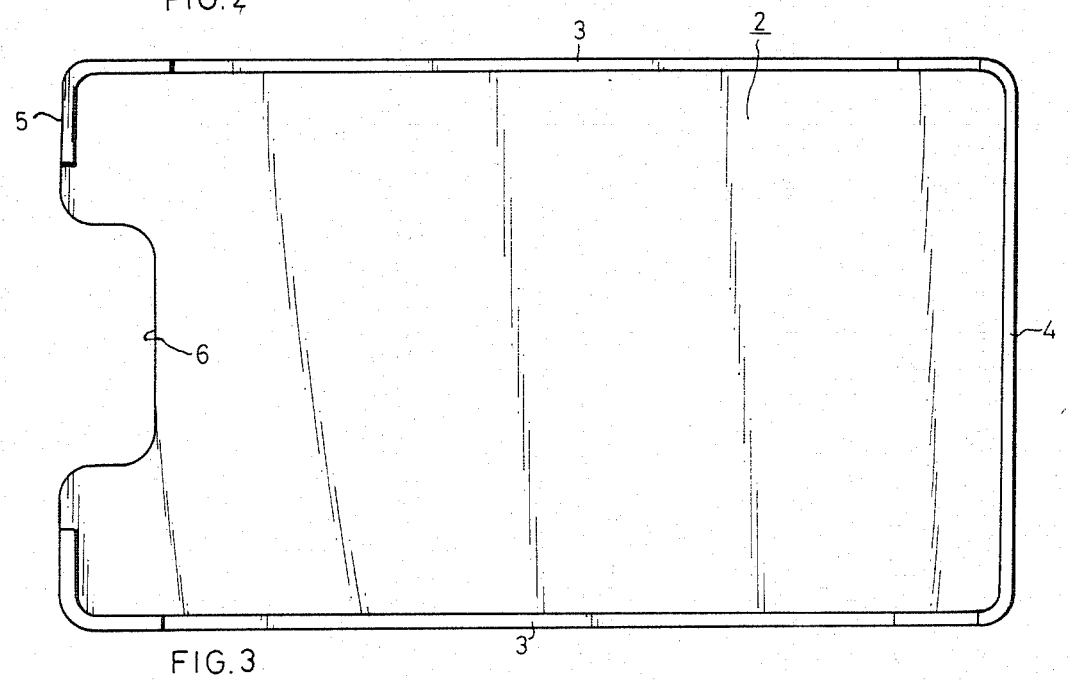
FIG. 2 is a rear plan view of a fitting case.
Figure 3:
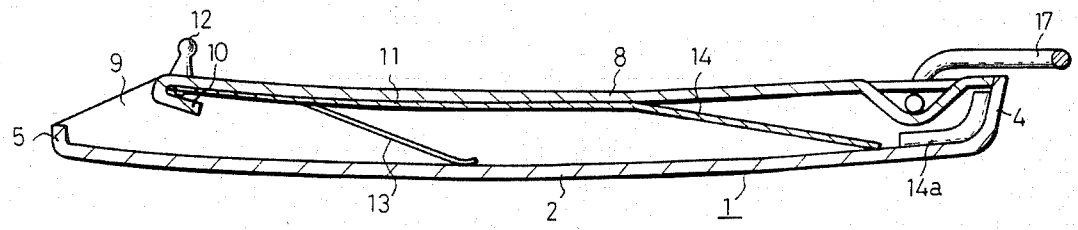
FIG. 3 is a cross-sectional view of the buckle body.

A fitting case 2, forming the front side of a metallic buckle body 1, has its upper and lower side portions 3 and base end portion 4 (right-hand end portion in FIG. 1) bent towards the rear at substantially a right angle. As shown in FIGS. 2 and 3, the fitting case 2 has its foremost portion bent back to provide upper and lower engaging portions 5. The purpose of the engaging portions 5 is to engage with the outer end portion of a plate-like tool having plural functions, that is, a multipurpose tool 7, and lock the same against inadvertent extraction when the tool is inserted fully into the inside of the fitting case 2. The purpose of the notch 6 is to facilitate removal of the tool 7 from the inside of the fitting case 2. The tool 7 is a square-shaped multi-purpose tool performing at least two functions.

A base plate 8 forming the rear part of the buckle body 1 is welded to the inside of the upper and lower side portions 3 when seen in FIG. 2 and base end portions 4 of the fitting case 2. The foremost part of the base plate 8 (or the left-hand end in FIG. 1) is slightly receded towards the base end from the foremost part of the fitting case 2 for defining an opening 9 between the foremost parts of the case 2 and base plate 8 for insertion of the multipurpose tool 7.

The base plate 8 has its foremost part bent back towards the front side for providing a pin supporting portion 10, and a lock member 11 formed by a leaf spring has its base end caulked with a pin 12 in the inside of the pin supporting portion 10.

The lock member 11 is trifurcated into upper and lower short strips 13 and a long strip 14 intermediate said short strips. Each of the short strips 13 has its base end bent towards the front and its forward end bent slightly towards the rear. The long strip 14 is bent towards front at a position ahead of the bend line of the short strips 13 and acts for pressing the tool in the inside of the case 2 in cooperation with the short strips 13.

A stopper **14*a* is mounted inside the base end portion of the buckle member 1. The stopper 14*a* is positioned to engage with and abut on the foremost part of a cutter 22 of the tool 7 so that the tool 7 may be restrained from advancing too far into the interior of the buckle body 1**.

The pin 12 has its spherical end engaged with a hole 16 of a belt 15. To the base end of the buckle body 1, there is mounted a U-shaped belt holding member 17 which has its base portion engaged with one end of the belt 15 and has its both side portions bent parallel to its base portion and rotatably attached to a portion of the base plate 8.

The multipurpose tool 7 is accommodated and secured in the buckle body 1 and has spanners 18, 19 and a cap opener 20 in the form of through-holes as well as can opener 21, a cutter 22 and a saw blade 23 along the peripheral edge thereof.

The belt buckle of the present invention operates as follows.

Figure 1:
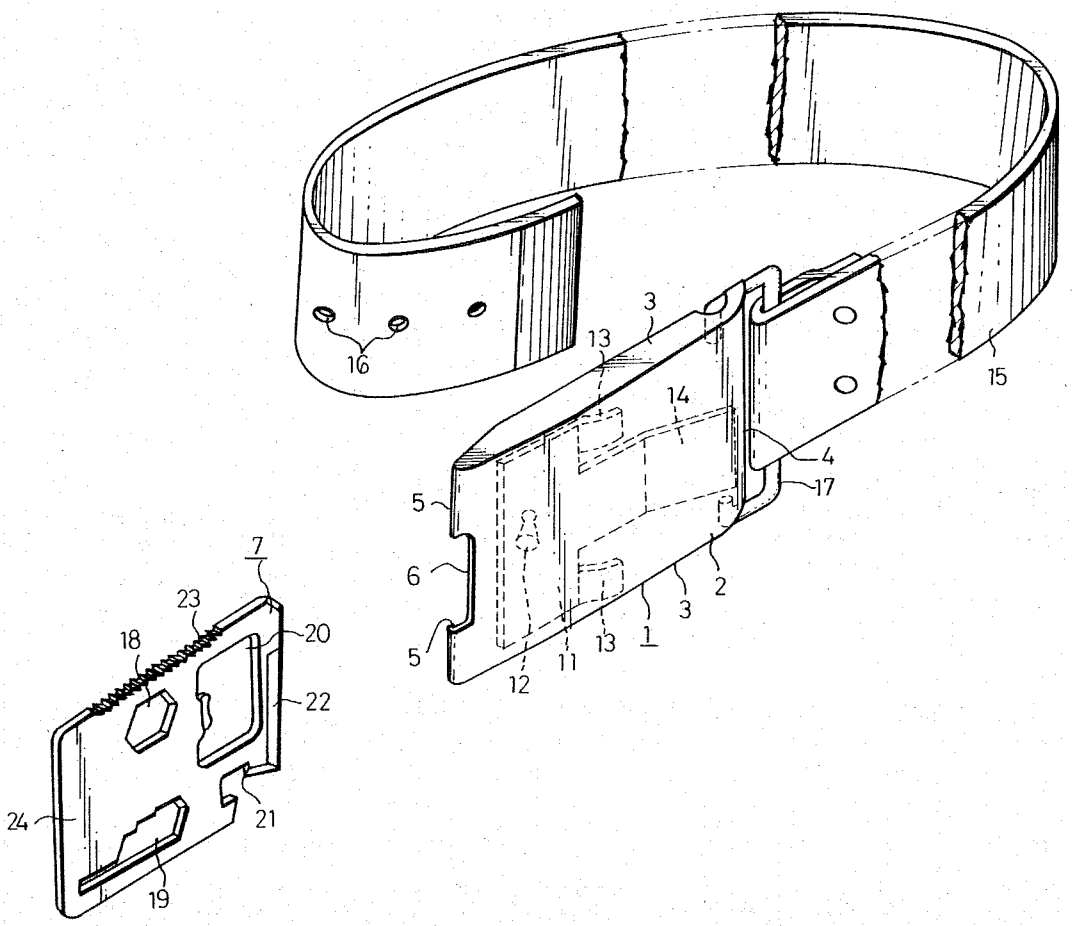
FIG. 1 is a perspective view of the belt buckle.

FIG. 1 shows the tool 7 taken out of the buckle body 1. When inserting the tool 7 into the buckle body 1, starting from this state, the tool 7 is introduced from the side of the cutter 22 into the opening 9 of the fitting case 2.

The inner end of the tool 7 is inserted along the lock element 11 secured to the inner surface of the base plate 8 and is advanced under a forward thrust force while being pressed down by short strips 13 of the lock element 11. As the tool 7 is inserted further, the lateral and central portions of the tool 7 are pressed down by the short strips 13 and the long strip 14 of the lock member 11, respectively.

There is no risk that the tool 7 be advanced too far into the interior of the buckle body 1 because the foremost part of the cutter 22 is engaged with and halted by the stopper 14*a*.

When the tool 7 is accommodated in the fitting case 2 in its entirety, the outer end of the tool 7 is positioned inwardly from the edge of the engaging portion 5 of the fitting case 2 so that the tool's said outer end is engaged with the inside wall of the engaging portion 5. At this time, the central part of the outer end of the tool 7 is exposed to the outside through the notch 6.

In this state, since the tool 7 is pressed down to the inner surface of the fitting case 2 by the strips 13, 14 of the lock element 11, there is no risk that the tool 7 may wobble in the fitting case 2. The tool 7 has its outer end engaged with the engaging portion 5 so that the tool 7 is locked unextricably in the fitting case 2 and may not be released from the buckle body 1.

Figure 4:
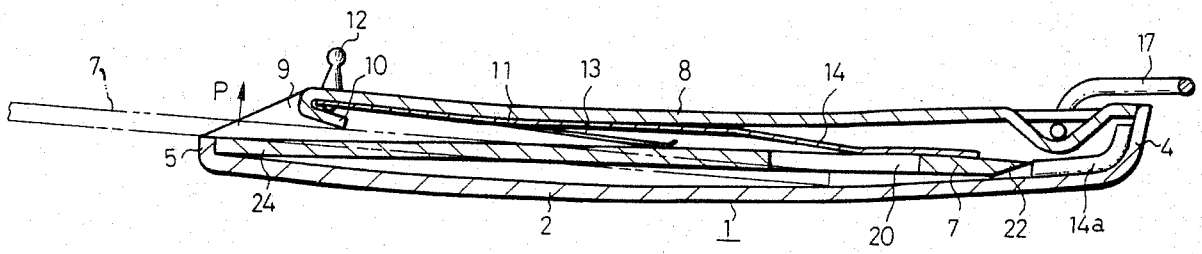
FIG. 4 is a cross-sectional view showing the multipurpose tool accommodated in the buckle body.

As shown in FIG. 4, since the foremost part of the long strip 14 acts on that portion of the tool 7 which is disposed between the cutter 22 and the cap opener 20 of the tool 7, there is no risk that the foremost part of the strip 14 be engaged with the cap opener 20. Moreover, when the tool is inserted fully into the buckle body 1, the short strips 13 are disposed slightly above the spanners 18, 19 and may not be engaged therewith despite the fact that the short strips 13 and the spanners are positioned in partial registration with one another in the fully inserted position of the tool.

When removing the tool 7 from the buckle body 1, finger pressure is applied to end portion 24 of the tool 7 exposed through the notch 6 of the fitting case 2 towards the rear or in a direction shown by the arrow mark P in FIG. 4 so as to disengage the portion 24 from the engaging portion 5 of the fitting case 2 and enable the tool 7 to be extracted out of the fitting case 2.

In this manner, the tool 7 may be withdrawn to the outside through the opening 9 along the inner side of the fitting case 2 as shown by the doubledotted lines in FIG. 4.

During withdrawal, the foremost part of the long strip 14 is not hooked by the cap opener 20, because the cap opener 20 of the tool and said foremost part are positioned out of registration with each other in the fully inserted position of the tool. Besides, since the pair of short strips 13 is bent back towards the rear at the foremost parts thereof, the strips 13 are not hooked by the spanners 18, 19, and the tool 17 may be withdrawn smoothly.

Since various changes can be made without departing from the spirit and scope of the invention, the invention is not limited to any specific embodiments thereof except as defined in the appended claims.

What I claim is:

1. A belt buckle comprising, in combination, a plate-like tool;

a fitting case for accommodating said tool;

a base plate mounted to the rear surface of said fitting case for forming a hollow buckle body therewith, and defining at the foremost part thereof an insertion opening for insertion of said tool;

a member secured to the inside of said base plate for pressing said plate-like tool onto the inner side of said fitting case;

engaging means formed on an edge of said fitting case defining said insertion opening for engaging with the outer end of said plate-like tool for locking said plate-like tool in place inside said buckle body when said member presses said plate-like tool onto the inner side of said fitting case;

a notch formed in the vicinity of said edge of said fitting case to enable the outer end of the plate-like tool to be grasped manually and moved away from the inner side of said fitting case so as to release said plate-like tool for engagement with said engaging means and thereby allow said plate-like tool to be removed from said hollow buckle body; and belt connection means provided to the base end of said buckle body for connecting said buckle body to the belt.

2. The belt buckle as claimed in claim 1, wherein said member is a leaf spring trifurcated into upper and lower short strips and a central long strip, said short strips pressing the central part of said tool and said long strip pressing the inner portion of said tool.

3. The belt buckle as claimed in claim 1 wherein said engaging means comprises the foremost part of said base plate.

4. The belt buckle as claimed in claim 1 wherein said tool is a square-shaped metallic multipurpose tool performing at least two functions.

5. The belt buckle as claimed in claim 1 wherein a stopper is provided on the inner surface of the fitting case opposite the foremost part of said base plate, said stopper engaging with and abutting on the foremost part of said tool upon insertion of said tool for controlling the final position of tool insertion.

* * * * *